United States Patent [19]

Sweeney et al.

[11] Patent Number: 4,938,474

[45] Date of Patent: Jul. 3, 1990

[54] EXERCISE APPARATUS AND METHOD WHICH SIMULATE STAIR CLIMBING

[75] Inventors: Michael T. Sweeney; Duane P. Stark; James S. Sweeney, Jr., all of Laguna Beach, Calif.

[73] Assignee: Laguna Tectrix, Inc., Irvine, Calif.

[21] Appl. No.: 289,563

[22] Filed: Dec. 23, 1988

[51] Int. Cl.[5] ..... A63B 23/04

[52] U.S. Cl. ..... 272/70; 272/69; 272/73; 272/129; 128/25 R; 73/379

[58] Field of Search ..... 272/69, 70, 72, 96, 272/112, 129, 130, 73; 73/379, 381; 128/25 R, 25 B

[56] References Cited

U.S. PATENT DOCUMENTS

| | | | |
|---|---|---|---|
| 3,497,215 | 2/1970 | Harrison et al. | 272/69 |
| 3,621,948 | 11/1971 | Dimick et al. | 188/76 |
| 3,704,886 | 12/1972 | Kay et al. | 272/73 |
| 3,759,511 | 9/1973 | Zinkin et al. | 272/58 |
| 3,970,302 | 7/1976 | McFee | 272/130 |
| 4,358,105 | 11/1982 | Sweeney, Jr. | 272/73 |
| 4,470,597 | 9/1984 | McFee | 272/70 X |
| 4,477,072 | 10/1984 | DeCloux | 272/73 |
| 4,496,147 | 1/1985 | DeCloux et al. | 272/130 |
| 4,519,603 | 5/1985 | DeCloux | 272/73 |
| 4,681,316 | 7/1987 | DeCloux | 272/130 |
| 4,685,666 | 8/1987 | DeCloux | 272/70 |
| 4,685,669 | 8/1987 | DeCloux | 272/130 |
| 4,687,195 | 8/1987 | Potts | 272/69 |
| 4,708,338 | 11/1987 | Potts | 272/129 X |
| 4,720,093 | 1/1988 | Del Mar | 272/70 |

FOREIGN PATENT DOCUMENTS

| | | | |
|---|---|---|---|
| 2202161 | 9/1988 | United Kingdom | 272/73 |

*Primary Examiner*—Richard J. Apley
*Assistant Examiner*—Joe H. Cheng
*Attorney, Agent, or Firm*—Thomas J. Plante

[57] ABSTRACT

An exercise apparatus is disclosed which simulates a stair climber, and which determines the amount of user exercise by the speed of rotation of a flywheel. The speed of the flywheel is controlled to maintain the desired speed of stair climbing by a friction belt engaging the flywheel. A rotary electrical motor is moved in one direction to tighten the belt on the flywheel and in the opposite direction to loosen the belt on the flywheel. A slack sensor determines whether the motor has been moved to a limit in the belt-loosening direction. Incremental changes of motor energy are used to gradually reduce an error signal between command speed and actual speed. Pulse width modulation is used to vary the motor energy in accordance with the size of the error signal.

35 Claims, 10 Drawing Sheets

EXERCISE APPARATUS AND METHOD WHICH SIMULATE STAIR CLIMBING

BACKGROUND OF THE INVENTION

This invention relates to exercise apparatus, and particularly to apparatus which simulates stair climbing.

In such apparatus, the user's energy is exerted in repeatedly lifting the user's body by shifting weight alternatively from one pedal to another. Each of two pedals moves between an upper position and a lower position. As one foot of the user presses down on the first pedal in its upper position, that pedal is driven down by the weight of the user, working against a resistance. The exercise apparatus then brings the second pedal to its upper position; and the user presses down on the second pedal with the other foot, raising the user's weight, and driving the second pedal down. The arrangement is such that a single resistance device provides the resistance for both pedals as they are separately urged downwardly.

An example of a stair climbing exercise apparatus is shown in Potts U.S. Pat. No. 4,708,338. In that patent, each pedal is moved up and down, as it travels along an arc at the end of a pivoted arm. Resistance is provided by a dynamic brake (alternator), combined with a transmission which converts the pedal motion to a much faster speed at the alternator. Each pedal is connected to the transmission by a one-way clutch which transfers force from each pedal arm to the transmission in only one direction of motion (the downward motion of the pedal). In the other direction of pedal motion, force is not transmitted between the pedal and the dynamic brake; and the pedal is returned to its upper position by a spring.

Two significant deficiencies of the stair climber just described are its high cost, and its limited speed range. The range limitation results from the inherent limitations of a transmission (gear box) driving the dynamic brake.

SUMMARY OF THE INVENTION

The present invention provides a "stair climber" which has a simple friction brake, preferably in the form of a friction band which engages the periphery of the flywheel. (A flywheel is normally used in a continuous motion device, in order to store energy, thereby causing smoother motion.)

The torque of the friction brake is automatically increased or decreased by an actuator, e.g., a motor, which moves in one direction to increase torque, and in the opposite direction to decrease torque. The need for increasing or decreasing torque is determined by a sensor which measures the actual rotational speed of the flywheel.

The object of the automatic motor control is to maintain a preselected (command) speed of flywheel rotation. Command speed values, including desired variations, may be pre-programmed or manually controlled. A computerized control compares the instantaneous desired speed and actual speed (as indicated by the sensor) and provides an error value. The error value is used to drive a control motor which either moves in one direction to tighten the band on the flywheel, or in the opposite direction to loosen the band on the flywheel.

The control system is digitally operated, i.e., pulsed signals from a microcontroller (CPU) determine the amount of energy applied to the motor, and its direction of motion. The digital control system is so arranged that it causes a gradual speeding up of the flywheel when the user mounts the stair-climber, and a gradual slowing down of the flywheel when the user dismounts the stair-climber. These controlled starting and stopping operations contribute significantly to the user's comfort.

BRIEF DESCRIPTION OF THE DRAWINGS

FIG. 7A shows the loosened, or slack, belt condition; and FIG. 7B shows the tightened belt condition.

DETAILED DESCRIPTION OF PREFERRED EMBODIMENT

Figure 1:
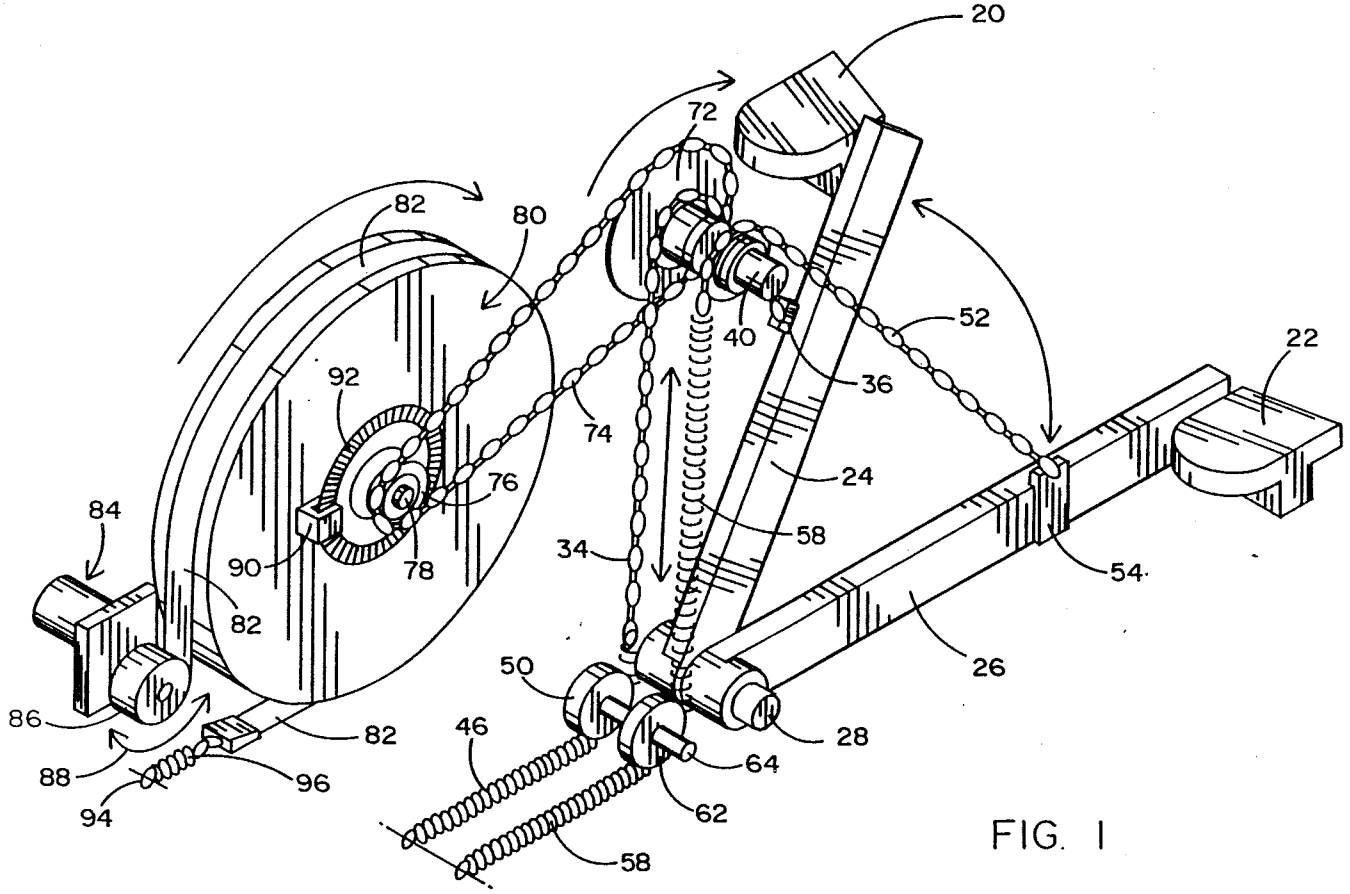
FIG. 1 is an isometric, diagrammatic view of the moving portions of the stair climber apparatus.
Figure 2:
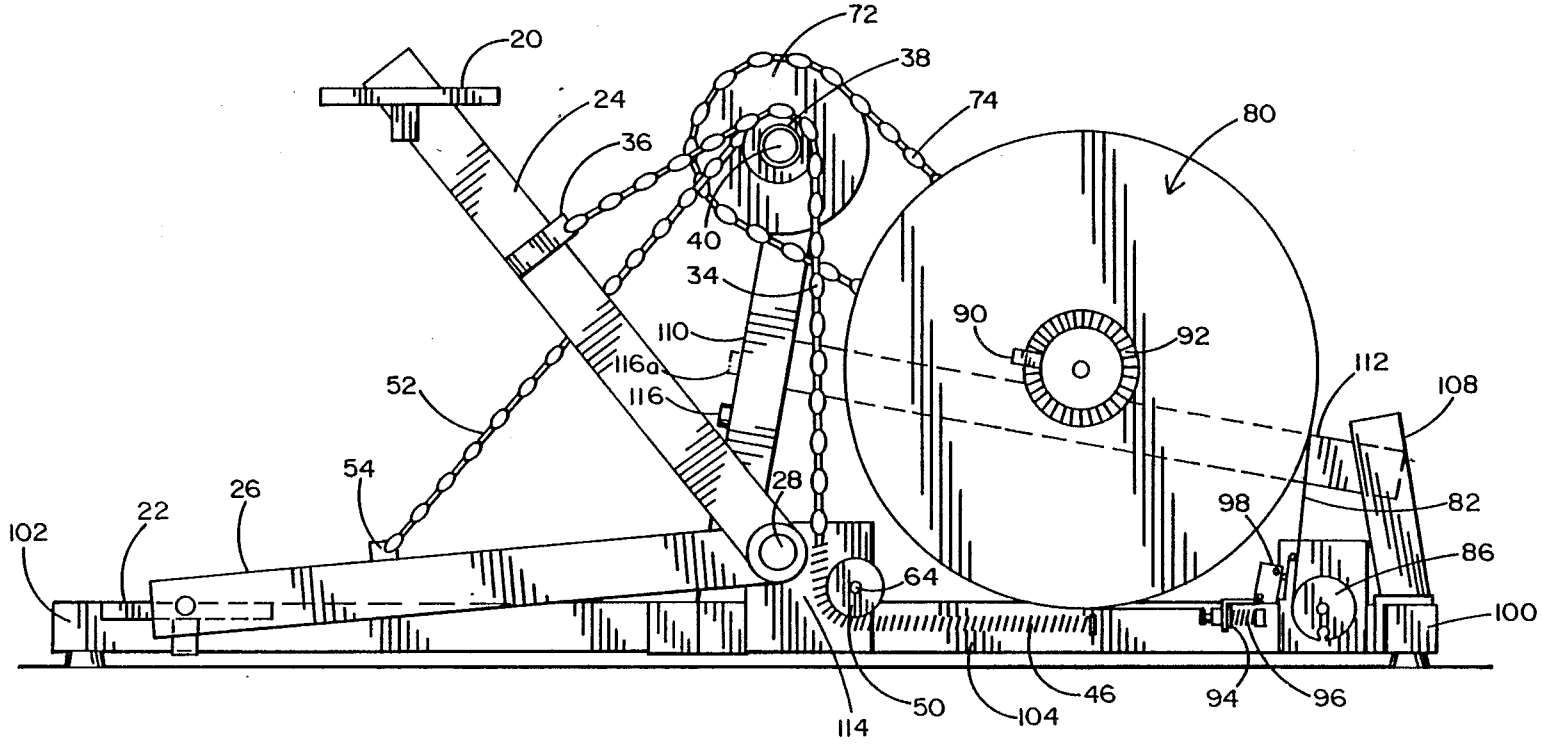
FIG. 2 is a side view of the apparatus of FIG. 1, including the supporting side frame members.
Figure 3:
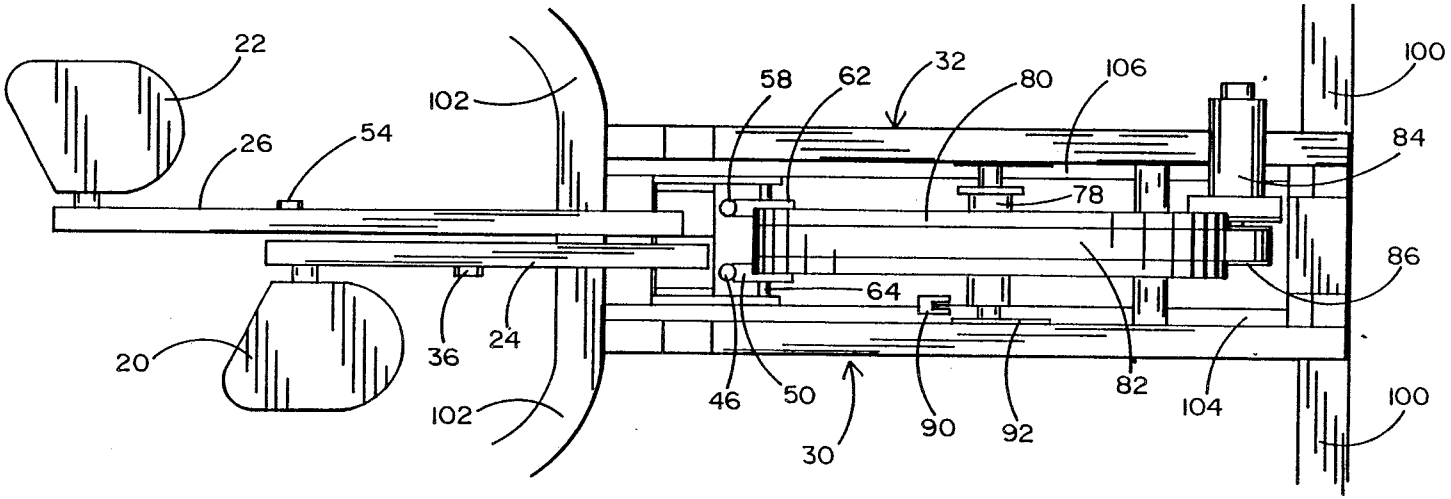
FIG. 3 is a plan view of the apparatus of FIG. 1.

As shown in FIGS. 1–3, two pedals are provided, on which the user can alternatively lift his/her body by stepping up with the right foot on a pedal 20, and then stepping up with the left foot on a pedal 22. The pedals 20 and 22 are pivotally mounted on crank arms 24 and 26, respectively; and the other ends of arms 24 and 26 are pivotally mounted on a shaft 28. Shaft 28 is supported in bearings carried by two supporting structures 30 and 32 (FIG. 3) located at opposite sides of the supporting frame, which will be detailed below.

As each crank arm 24 and 26 is moved downwardly, in turn, by the user's weight, its pedal moves along an arc centered at shaft 28. When the user's weight is transferred from one pedal to the other, the unloaded crank arm is returned to its upper position by a suitable return device, such as a spring. The motion of the two pedals is, therefore, independent reciprocating motion along an arcuate path.

In FIGS. 1–3, pedal 20 is shown in its upper position. A chain 34 is attached to its crank arm 24 at a bracket, or anchor, 36 mounted on arm 24 and located near pedal 20. Chain 34 engages, and is wrapped around, a sprocket 38 (see FIGS. 2 and 4), which is mounted on a one-way drive shaft 40. Drive shaft 40 is supported in bearings 42 and 44 carried by the side supporting structures of the frame.

The end of chain 34 remote from bracket 36 is attached to a spring 46, which is anchored to the frame of the apparatus, and which is wrapped around an idler pulley 50. With pedal 20 in its uppermost position, spring 46, a tension spring, is in its least extended position. It has just returned pedal 20 to its uppermost position, ready for the user's weight to be shifted to pedal 20.

Pedal 22 is shown in its lower position, to which the weight of the user's body, supported on the user's left foot, has driven it. A chain 52 is attached to its crank arm 26 at a bracket, or anchor, 54 located near pedal 22. Chain 52 engages, and is wrapped around, a sprocket 56 (see FIG. 4), which is mounted on the same drive shaft 40 as sprocket 38.

The end of chain 52 remote from bracket 54 is attached to a spring 58, which is anchored to the frame of the apparatus, and which is wrapped around an idler pulley 62. With pedal 22 in its lowermost position, spring 58, a tension spring, is in its fully extended position. It is ready to return pedal 22 to its uppermost position, as soon as the user's weight is removed from pedal 22. A single shaft 64, supported by the two side supporting structures 30 and 32, may serve as the axis of both idler pulleys 50 and 62.

In order for the apparatus to resist the user's weight sufficiently to permit the user to lift his/her body alternately with the left and right legs, an adequate resistance must oppose the downward motion of each pedal 20 and 22. A single resistance system is adequate, because each of the sprockets 38 and 56 is arranged to drive shaft 40 by means of a one-way (freewheeling) clutch.

Figure 4:
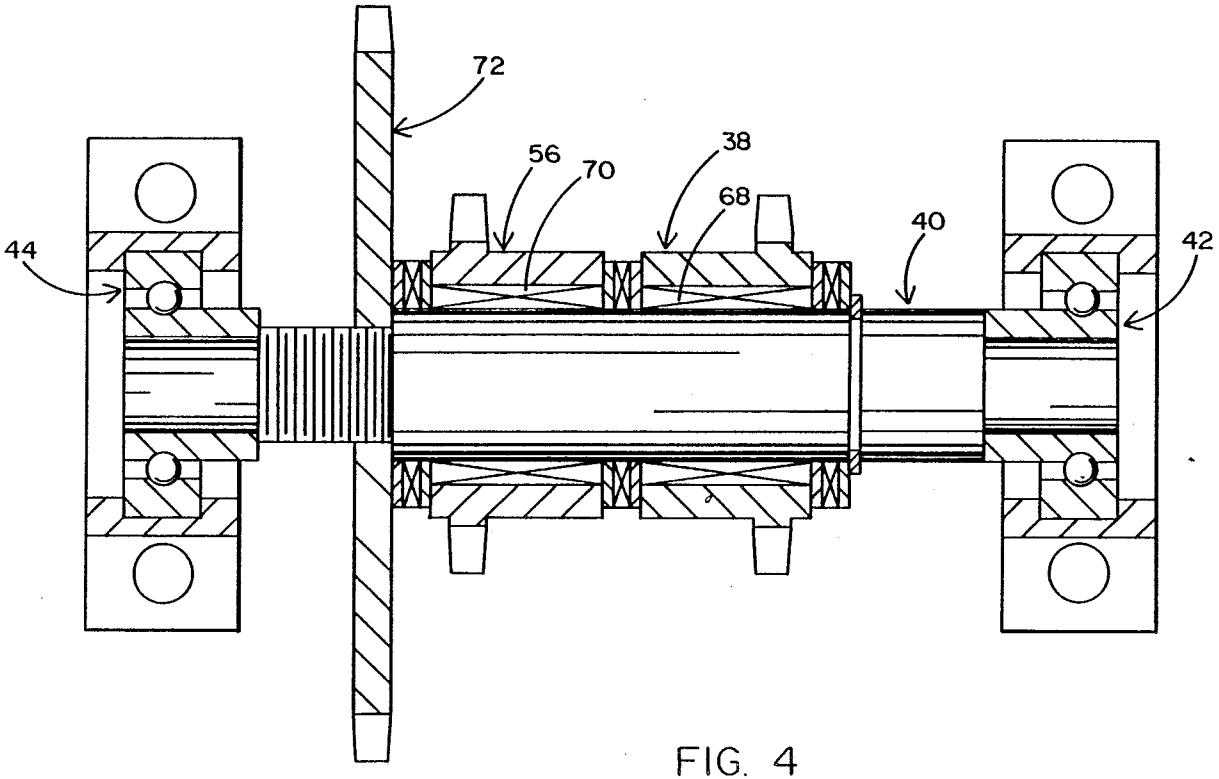
FIG. 4 is a cross-section taken through the drive shaft, which is driven by the user-exerted pressure on either foot pedal.
Figure 5:
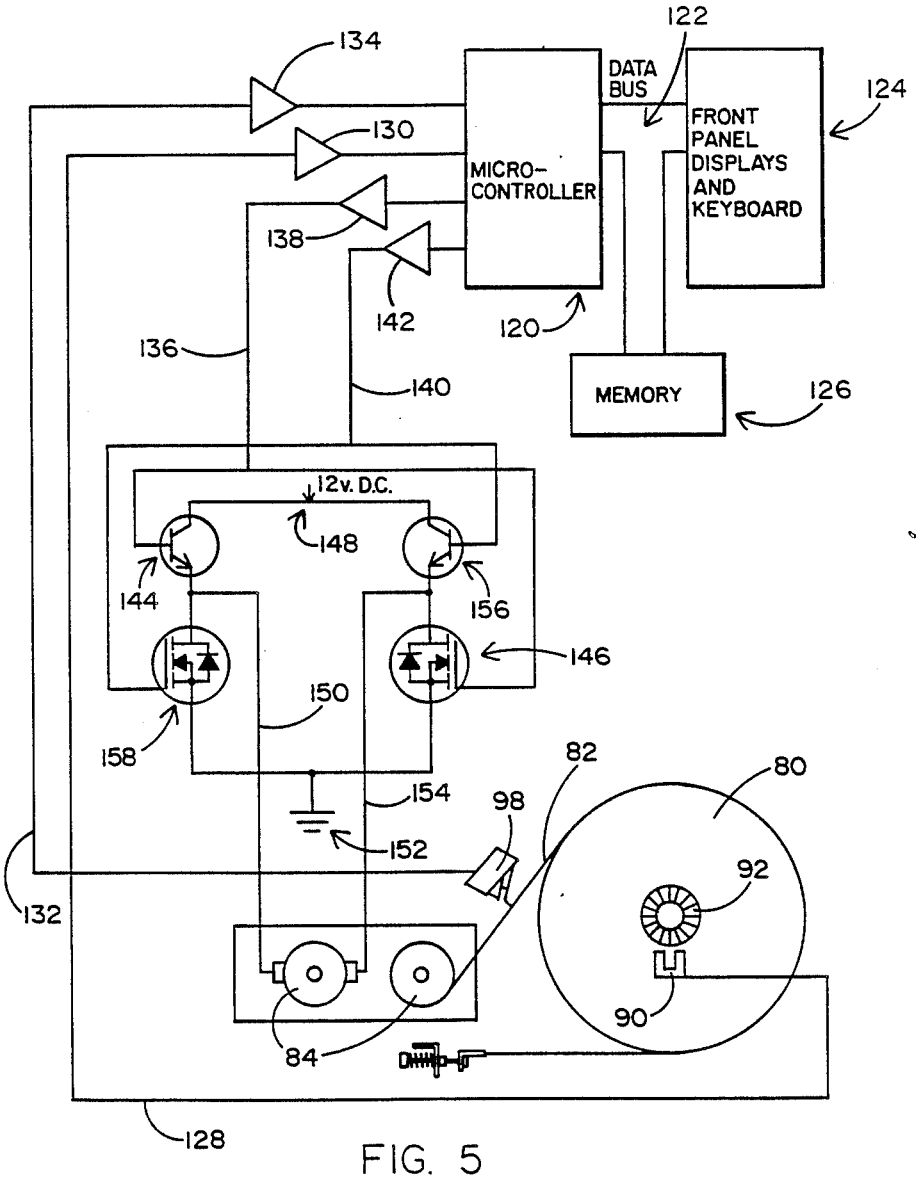
FIG. 5 is a block diagram of the electronic system which automatically controls the flywheel speed.

As shown in FIG. 4, sprocket wheel 38 is mounted on a one-way roller clutch 68, and sprocket wheel 56 is mounted on a one-way roller clutch 70. Drive shaft 40 is rotated by its sprocket wheels 38 and 56 only in a counterclockwise direction, as shown in FIG. 2 (clockwise as seen in FIG. 1). When either pedal 20 or pedal 22 moves downwardly, it causes its one-way roller clutch to rotate shaft 40 in the same direction. When either pedal is moving upwardly, its one-way roller clutch transfers no driving energy to shaft 40.

As shown in FIGS. 1, 2 and 4, drive shaft 40 has secured thereto a larger drive sprocket 72. Rotation of sprocket 72 drives a chain 74, which in turn drives a sprocket wheel 76 (see FIG. 1) mounted on a drive shaft 78. Drive shaft 78 is secured to, and therefore causes rotation of, a flywheel 80. As seen in FIG. 1, the directions of rotation of sprocket wheels 72 and 76, and of flywheel 80, are indicated by the arrows. The weight of flywheel 80 provides some resistance, but its primary function is to store energy, and thus provide a smooth speed response. In practice, it has proved preferable to have the member 78 act as a non-rotating axle, instead of a rotating shaft; and to have the sprocket wheel 76 directly secured to the flywheel 80, in order to cause their common rotation (supported on bearings) around the axle.

The resistance to downward motion of the pedals 20 and 22, which is necessary to permit the user to lift his/her body weight, is provided by a braking mechanism using variations in friction to maintain the desired speed of motion of the crank arms 24 and 26. This frictional resistance is conveniently provided by a belt 82, which is wrapped around, and in frictional engagement with, the periphery of flywheel 80.

The use of a friction device to vary resistance in an exercise apparatus has been common. However, in many cases, the friction is manually set by simple mechanical brake control means. For example, Del Mar U.S. Pat. No. 4,720,093 shows a belt 40 contacting the rim of a flywheel 30 "so as to maintain a frictional force in an amount which is determined by the load applied". Such an arrangement is not sufficiently sophisticated to provide the desired "feel" for the user of a stair climbing apparatus.

In the present apparatus, the friction belt is used to control the speed of motion of the flywheel, and of the crank arms which drive the flywheel. A command desired speed is selected by the user. An electronic control device (CPU) compares feedback from a speed sensor with the command speed, develops an error value representing either overspeed or underspeed of the flywheel, and automatically controls a motor which is movable in one direction to tighten the belt and in another direction to loosen the belt. The error value represents the difference, if any, between the command speed, stored in the CPU, and the actual speed, measured by the speed sensor.

As shown in FIGS. 1-3, a belt-tension-controlling motor 84 drives a pulley 86, around which one end of belt 82 is wrapped. Motor 84 may be a DC gear motor, which tightens belt 82 when the motor rotates in one direction, and loosens belt 82 when the motor rotates in the opposite direction (note the two-way arrow 88 in FIG. 1).

The speed of motion of flywheel 80 may be sensed by an optical sensor 90 mounted on the frame of the apparatus, and cooperating with an encoder disk 92 mounted on the hub of the flywheel. A digital signal is generated as each encoder line passes the optical sensor. A 50-line encoder disk has proved satisfactory. The number of lines in the encoder disk is dictated by the desired fineness of resolution in the speed feedback signal.

The end of belt 82 remote from tension control motor 84 is anchored at 94 to the frame of the apparatus. Experience with the stair climber indicates that an anchor spring arrangement 96 is desirable to provide a resilient connection between the anchor point 94 and belt 82. Another valuable feature, which solves certain problems sometimes encountered, is a belt slack sensor 98 (FIGS. 2, 5, 7A and 7B), which is located near the motor-connected end of belt 82, and which is an electrical switch caused to move between its on and off positions by the amount of slack in belt 82.

FIGS. 2 and 3 show the supporting frame of the apparatus. Referring to the user side of the stair climber as the rear and to the flywheel side as the front, a horizontal supporting bar 100 extends transversely across the front, and a horizontal U-shaped supporting bar 102 extends transversely across the rear, of the supporting frame. Because the rear bar 102 is U-shaped, the user access area is open, allowing easy and unobstructed approach to the pedals 20 and 22. Horizontal side bars 104 and 106 join the front and rear bars 100 and 102 at opposite sides of the frame.

The vertical frame, which provides support for the flywheel 80 and for the driving sprockets shown in FIG. 4, comprises frame members located on each side (left and right) of the apparatus. Such frame members on one side of the apparatus are seen in FIG. 2. A front upwardly-extending support member 108 and a rear upwardly-extending support member 110 are connected by a front to back support member 11 2. The support members 112 (left and right) provide support for the flywheel shaft 78. The upper ends of support members 110 (left and right) provide bearings for the pedal-driven shaft 40. Two supporting plates 114 (left and right) support shaft 28, on which the crank arms 24 and 26 are pivoted. Plates 114 also support the shaft 64 which carries idler pulleys 50 and 62.

As seen in FIG. 2, the upward motion of each pivoted arm 24 and 26, under the bias of its return spring, is limited by a suitable mechanical bar, or rod, 116 which extends laterally between, and is secured to, the two upwardly-extending support members 110. In FIG. 2, the height of the user's step is limited by the lower position of rod 116. If a higher user step is desired, bar 116 may be removed from its lower position, and secured at the position 116a, shown in dashed lines. Additional step height adjustment positions may be used, if desired. In order to minimize the noise of contact, each arm is padded in the region which engages the rod 116.

Figure 6:
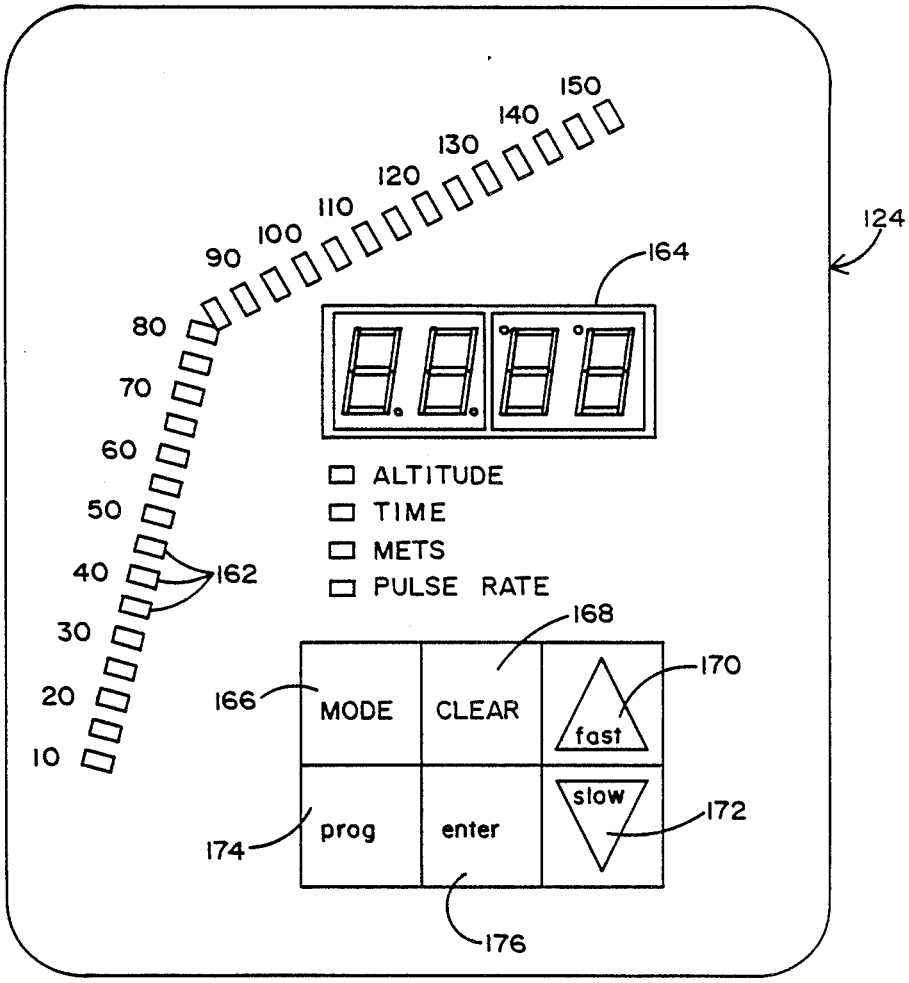
FIG. 6 is a plan view of the display panel, which contains the microcontroller (CPU)

The automatic speed control system is the primary aspect of the present invention. This system is diagrammed in FIG. 5. A microcontroller (CPU) 120 is linked by data bus 122 to a front panel 124 and a memory 126. The front panel 124 provides both a display which supplies information to the user, and a keyboard which permits the user to enter command selections. The command options are shown in FIG. 6, which shows the display panel.

The primary command is the desired speed of operation. This speed may remain at a selected level, or it may be varied in accordance with a selected automatic program.

The microcontroller 120, in addition to receiving the command signal, receives two feedback signals from the moving portions of the stair climber. A flywheel speed signal is directed to the microcontroller on line 128, after being amplified at 130. This signal, as previously stated, is provided by an optical sensor 90 cooperating with encoder disk 92 mounted on flywheel 80. In the microcontroller 120, this speed signal feedback, representing actual speed, is compared with the command signal, producing an error signal which is used to control gear motor 84 (which is shown in duplicate in FIG. 5, in order to show separately its electrical connections and its connection to band brake (belt) 82.

Another sensing device is slack sensing switch 98 connected by line 132 through amplifier 134 to microcontroller 120. The functions of slack sensing switch 98 will be discussed in detail below.

The control signals sent by microcontroller 120 to motor 84 are preferably pulsed signals having variable pulse widths. Signals to the motor 84 to tighten belt 82 on flywheel 80 follow line 136, after amplification at 138. Signals to motor 84 to loosen belt 82 on flywheel 80 follow line 140, after amplification at 142. A pulsed signal on line 36 enables a bipolar transistor 144 and a FET (preferably MOSFET) transistor 146, in order to connect the left side of motor 84 to a voltage source 148 via line 150, and to connect the right side of motor 84 to ground 152 via line 154. This causes motor 84 to turn in a clockwise direction, tightening belt 82. A pulsed signal on line 140 enables a bipolar transistor 156 and a FET (preferably MOSFET) transistor 158, in order to connect the right side of motor 84 to voltage source 148 via line 154, and to connect the left side of motor 84 to ground (152) via line 150. This causes motor 84 to turn in a counterclockwise direction, loosening belt 82.

It is desirable to vary the pulse width of the digital signals from the CPU to the motor control system, in order to provide motor driving energy which depends (in part) on the size of the error signal. It is also desirable to provide higher and lower frequencies of the digital signals to the motor control system, depending on certain factors. A higher frequency signal is used when the motor is tightening the belt than when it is loosening the belt. This reflects the greater energy need during belt tightening, due to the facts that flywheel rotation frictionally opposes the belt-tightening force, and that the motor is working against the belt anchor spring. It is also desirable to use a higher frequency signal in order to cause the next update to occur sooner than it otherwise would. Experience has indicated that a two-to-one ratio of the motor count rate works effectively. As an example, it has proved satisfactory to use a pulse frequency of 120 Hz as the higher value (when the motor is causing tightening, or is stopped), and a pulse frequency of 60 Hz as the lower value (when the motor is causing loosening).

Another unusual aspect of the control system is the use of the switch 98, which senses excessive slack in friction belt 82. This switch is necessary in order to prevent motor 84 from turning so far in the belt loosening direction that it starts to tighten the belt. The sensor switch 98 provides additional benefits. During the slowing down process, the slack sensor prevents sudden speed reduction. In other words, it causes a cyclical process in which the belt is alternately engaged with, and disengaged from, the flywheel, thereby causing a continuing, but not abrupt, reduction of speed. This facilitates dismounting by the user. Another effect of the slack sensor is to turn the motor off when the flywheel has stopped, and to position the system for a subsequent gradual start up. If the belt were not left in the slack position after dismount, the next user would encounter a full initial resistance. That would tend to prevent flywheel motion, and thus prevent the motion-sensing required to start the control system.

FIG. 6 shows a possible layout of the display panel 124. A series of LEDs 162 represent ascending values of user climbing speed, the numbers shown ranging from 10 to 150 in increments of 10. The numerals indicate feet climbed per minute; so each space between two adjacent LEDs represents 5 feet per minute. The "knee" formed between the 80 feet per minute LED and the 85 feet per minute LED is an arbitrary aspect of the visual design.

A numerical display window 164 is available for display of several possible values. The user can successively move through the four listed values by pushing a "Mode" key 166. "Altitude", when shown, displays at panel 164 the total feet climbed by the user. "Time", when shown, displays at panel 164 the total completed time of the exercise period. "Mets" is a value indicating "metabolic equivalent", which is based on a theoretical oxygen intake per kilo of weight. "Pulse Rate" is a value available for display, if a pulse rate sensor is connected between the panel 124 and the user's body.

A "Clear" key 168 is pushed to reset the timer and the altitude back to zero. The two keys "fast" at 170 and "slow" at 172 are provided to permit the user to adjust at will the selected speed of the flywheel (and thus the amount of user work). The "prog" key 174 is used to provide a pre-determined automatic program. The program may be selected from a group of built-in programs, or a user-designed program may be set up. An "enter" key 176 permits the user to choose between a built-in program or a user-designed program. The built-in programs, which might number ten or more, are desigated PR1, PR2, etc., in the User's Manual. For entering a built-in program, the numeric window provides a prompt, to be controlled by successive actuations of the "prog" key. For entering a user-designed program, the manual option would be selected by the "enter" key, and then the "fast" and "slow" keys would be used to select different speeds. Because the arbitrarily determined resolution of selected speed values is 5 feet per minute, the command values stored in the memory of microcontroller 120 vary in increments of 5 feet per minute up to 150 feet per minute.

Figure 7A:
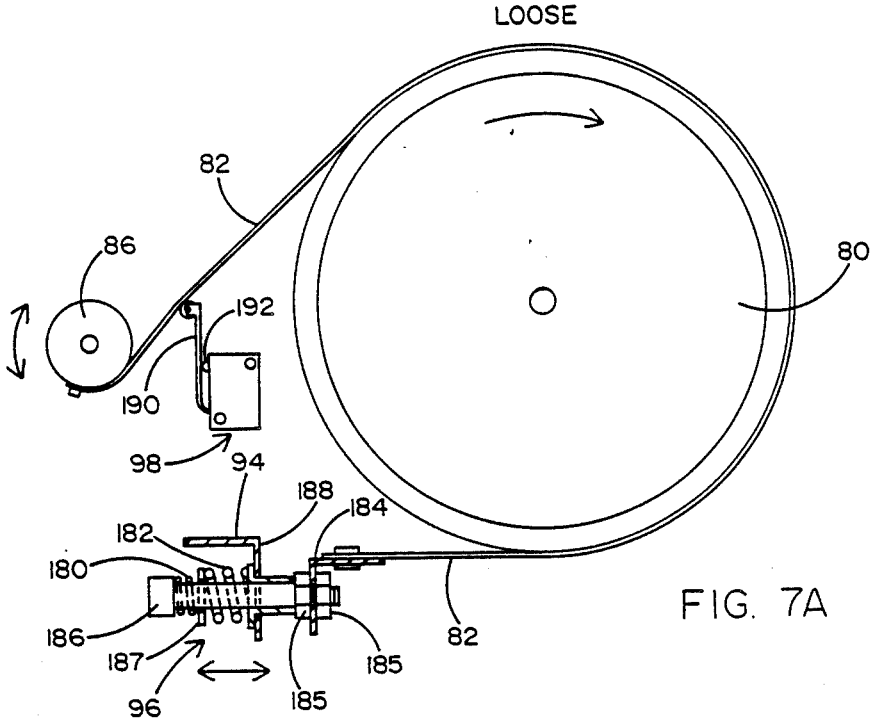
FIGS. 7A and 7B show details of the slack sensor, which is near the motor connected end of the friction belt, and of the anchor springs, which provide a resilient relation between the other end of the friction belt and its anchor.
Figure 7B:
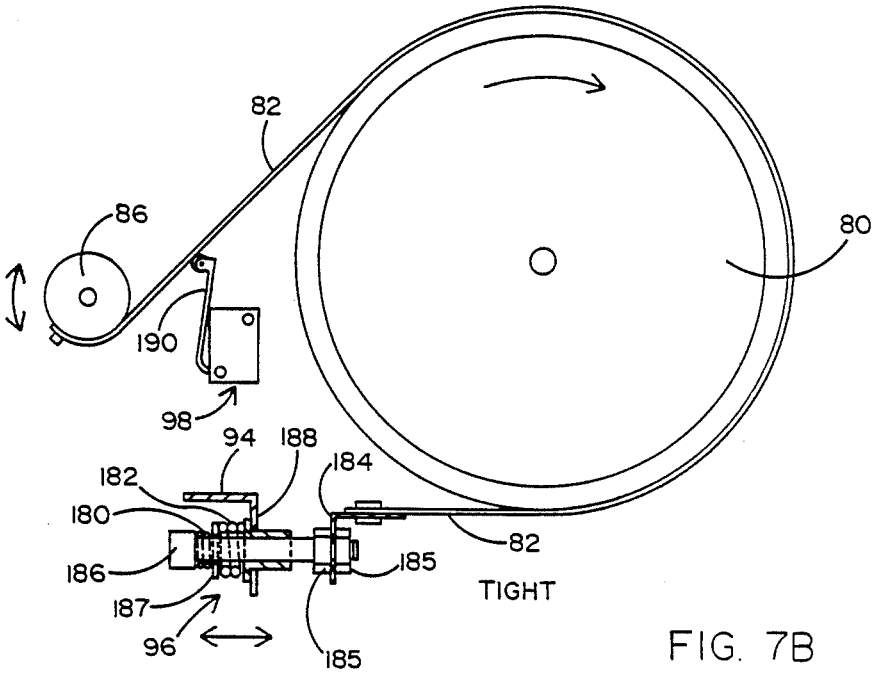

FIGS. 7A and 7B show the slack sensor switch 98, and its relation to belt 82, and to the anchor spring arrangement 96. The benefits of the anchor spring arrangement include a smoothing of the belt engagement feel, and an improvement of the motor action linearity (because of increased motor travel). Experience with prototype operation has led to several preferences in this structure. One preference is the use of a two-stage spring, in which one of the springs bottoms after some belt movement away from anchor 94. This provides a greater resilience (lighter resistance) initially, during compression of a light spring 180. When spring 180 bottoms, a greater resistance to belt movement is provided by a heavier spring 182. The reasons for the desirability of this two-stage spring are not fully understood; but it does tend to cause smoother operation of the apparatus. The anchored end of belt 82 is shown connected to a bracket 184 by two nuts 185 on a bolt 186. The light compression spring 180 is between the head of bolt 186 and a washer 187. The heavy compression spring 182 is between washer 187 and the flange 188 of anchor 94.

At the other end of belt 82, the belt is secured to pulley 86, which is driven by motor 84. The slack sensor 98 has an internal switch (not shown), and a switch control arm 190, which is held against belt 82 by a spring-biased member 192. The arm 190, which preferably has a roller engaging the belt, is shown in the slack-sensing position in FIG. 7A. In FIG. 7B, the tightened belt has pushed arm 190 to the right, moving spring-biased member 192 into its retracted position. The switch in slack sensor 98 may be open when the belt is tightened and closed when the belt is loosened, or vice versa. Experimental efforts indicate a preference for an open switch in the FIG. 7A position. In any event, the CPU is informed by the slack sensor whether or not the belt has loosened to the slack sensing position.

As stated, FIG. 7A shows belt 82 in its loosened position with respect to pulley 80. The two compression springs 180 and 182 at the anchor are extended; and the switch 98 is in its slack sensing position. FIG. 7B shows belt 82 in its fully tightened position with respect to pulley 80. The two compression springs 180 and 182 at the anchor are fully compressed; and the switch 98 is in its belt-tightened position. Of course, intermediate conditions frequently occur, in which the belt is in neither the fully-tightened position nor the slack sensing position.

Figure 8:
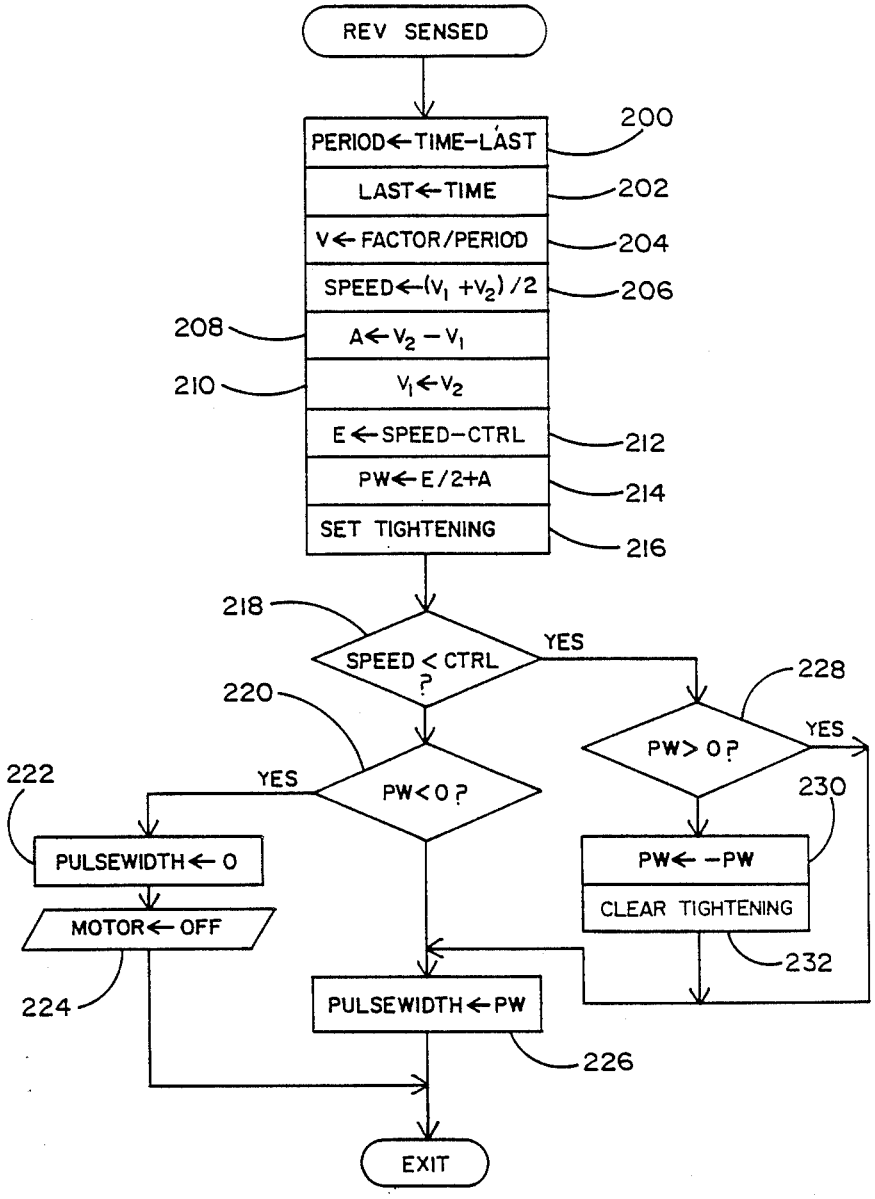
FIGS. 8, 9 and 10 show flow charts outlining the CPU logic which controls the motor operation.
Figure 9:
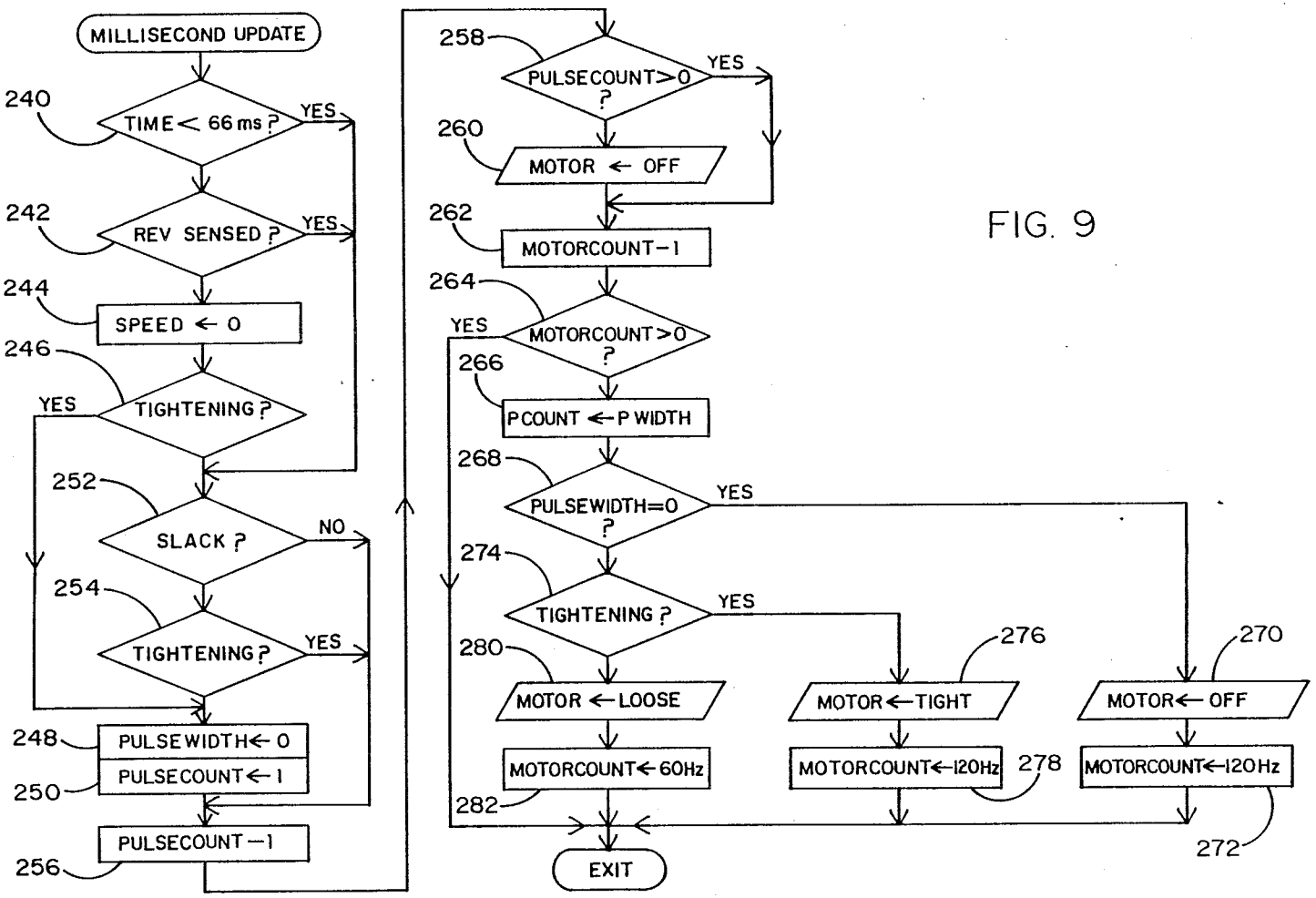
Figure 10:
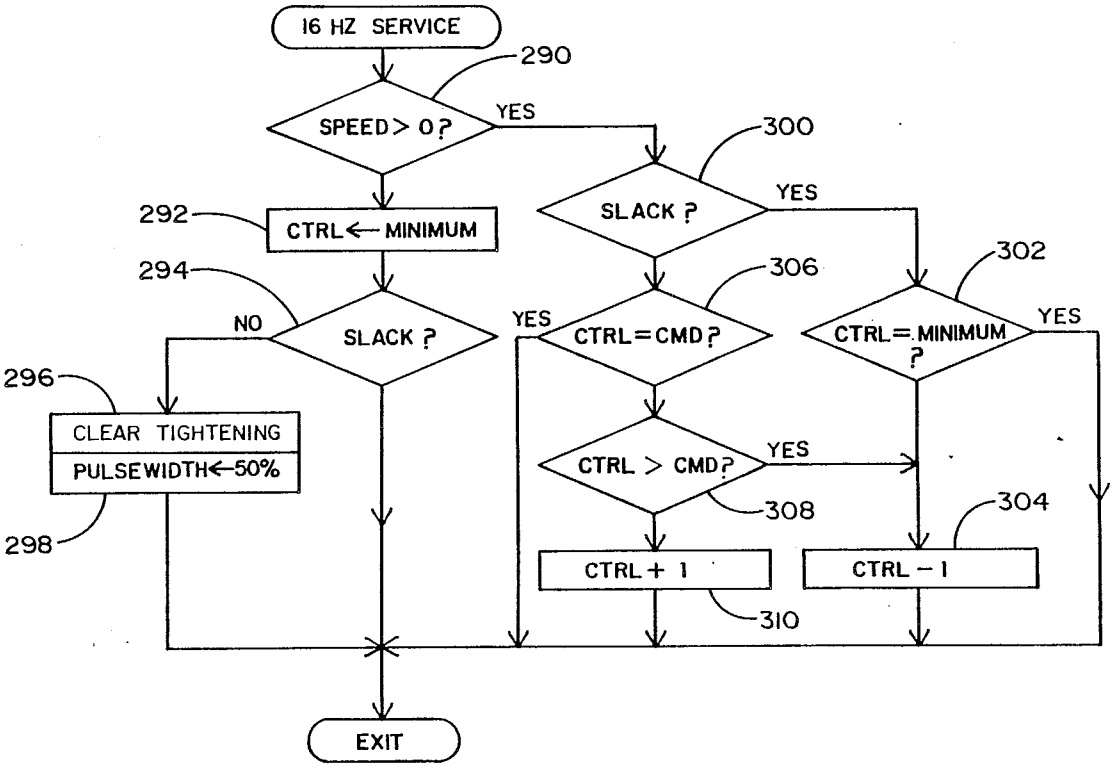

FIGS. 8–10 show flow charts of three portions of the logic system of microcontroller 120, used in controlling the operations of motor 84. FIG. 8, headed "Rev Sensed", shows what happens when the microcontroller 120 receives a pulse from the optical encoder 90–92 on the hub of flywheel 80. FIG. 9, headed "Millisecond Update", illustrates three basic procedures: (a) flywheel stop detection, (b) turning the motor off under two limit conditions, and (c) generating a pulse-width modulated motor drive signal. FIG. 10, headed "16 Hz Service", shows an incrementing and decrementing process which determines a "Control" value used in moving toward the "Command" value. As usual, rectangular blocks denote processes, diamond shaped blocks denote decisions, parallelograms denote input-/output operations, and lines with arrows indicate logic flow (except that top-to-bottom progress through contiguous blocks is assumed).

In FIG. 8, when each new speed sensor pulse is received at process block 200, the period between the new pulse, called "Time", and the previous pulse, called "Last", is calculated. This period is determined by counting clock signals. At process block 202, the current time is saved as "Last", for use in determining the period between it and the next pulse. At process block 204, a value V, which is a raw velocity value, is calculated by dividing a scale factor called "Factor", by the time Period. The scale factor is such that, taking all dimensional values into account, the calculated value of V will represent a number of feet per minute. At process block 206, a "Speed" value is arbitrarily assigned the average of the last two velocity values, $V_1$ and $V_2$. This averaging is useful in avoiding aberrant values. At process block 208, an Acceleration-related value A is calculated as the difference between the latest velocity value $V_2$ and the previous velocity value $V_1$. The value A may be either positive or negative. At process block 210, the latest velocity value $V_2$ is stored as the old velocity value $V_1$ for use with the next pulse.

At process block 212, the error value E, which may be either positive or negative, is calculated as the current speed (see block 206) minus an arbitrary control value, called "Ctrl". The error value represents feet per minute, because both the actual speed and the command speed have been expressed in feet per minute. The control value (also expressed in feet per minute) is not the same as the command speed value, previously set by the user. It is a value used for determining the rate at which the command value will be reached. It thus serves the important purpose of providing gradual, rather than abrupt, changes in the control system.

Another value which is used as an intermediate, rather than a final, value is "PW", shown at process block 214 as set at one-half E plus A (acceleration). The PW value is subsequently used in determining the pulse width.

At process block 216, the tightening flag is set. When this flag is set at tightening, belt tightening is selected. When this flag is cleared, belt loosening is automatically selected.

At decision block 218, it is determined whether flywheel speed is less than the control value, which would be indicated by a negative value of E. If it is not, at decision block 220, it is determined whether the value PW is negative. If PW is negative, process block 222 sets Pulsewidth at zero (thus clearing Pulsewidth), and input/ output block 224 causes the motor to be turned off. If, at decision block 220, PW is not negative, at process block 226 the value of Pulsewidth is assigned the value of PW.

If Speed is less than Ctrl (at decision block 218), but PW is positive (at decision block 228), the result is the same as if Speed had been greater than Ctrl. In other words, the belt might be tightened if the actual speed is less than the control value, but increasing, in order to provide more stable control by anticipating future actual speed. On the other hand, if the PW value is negative (at decision block 228), it is set positive (at process block 230), and the Tightening flag is cleared (at process block 232). In either case the PW value is assigned to Pulsewidth (at process block 226).

In FIG. 9, a stop is detected when no pulses are received within a 66 ms period (which is the period at which a 16-bit timer counter overflows). This corresponds to about 2 feet per minute, which is a very slow climbing rate. Tightening motion is stopped when the flywheel stops. At decision block 240, it is determined whether the elapsed time between pulses has reached 66 ms. If the Time is not less than 66 ms, and if no pulse has been sensed at decision block 242, a limit condition for causing motor stop has been detected. At process block 244, Speed is assigned zero value, and it is determined at decision block 246 whether the Tightening mode is in effect. If the answer is "yes", the next step reaches process blocks 248 and 250. Process blocks 248 and 250 represent a limit condition, i.e., a condition in which the motor should be stopped. At block 248 the motor Pulse-width is set to zero and, at process block 250, the Pulse Count is set to one, so that it will time out immediately.

Process blocks 248 and 250 are reached by two routes, one of which has just been traced. The other route to blocks 248 and 250 is through both decision block 252, if it shows that slack is indicated by the slack sensor switch, and through decision block 254, if it shows that the brake is not in the tightening mode. In other words, the appearance of slack when the brake is in the loosening mode indicates that the motor should be turned off. Any one of three routes will cause the logic flow to reach decision block 252: (a) if the answer at decision block 240 indicates that Time is less than 66 ms, (b) if the answer at decision block 242 is that a speed sensor pulse has been received, or (c) if the answer at decision block 246 is that the brake is not in the tightening mode.

If, at decision block 252, slack has not been indicated, or if, at decision block 254, the tightening mode is found to be in effect, the logic flow bypasses blocks 248 and 250, and moves to process block 256, at which the Pulse Count is decremented by one. Next, at decision block 258, it is determined whether the Pulse Count is greater than zero. If it is not, input/output block 260 causes motor turn off. If, at decision block 258, the Pulse Count is greater than zero, block 260 is bypassed, leading to process block 262, at which the Motor Count is decremented by one. (This also occurs after motor shut off at block 260.) At decision block 264, it is determined whether the Motor Count is greater than zero. If the answer is "Yes", the remaining blocks in FIG. 9 are bypassed.

Pulse width modulation is implemented using two counters, Pulse Count, which sets the width of the motor pulse, and Motor Count, which controls the frequency. When Pulse Count decrements to zero, the motor is turned off. When Motor Count decrements to zero, the motor is turned on according to an internal flag ('Tightening'), Pulse Count is loaded from Pulse Width, and Motor Count is set to a frequency value which will yield 60 Hz or 120 Hz, depending on the motor direction.

Pulse Count is decremented (at block 256); and if it is zero (at block 258), the motor is turned off. Motor Count is decremented (at block 262), and if it is not zero (at block 264), the rest of the procedure is skipped.

If, at block 264, the motor count is zero, the Pulse Count is set to the value of Pulse Width at process block 266. Next, at decision block 268, it is determined if Pulse Width is zero. If the answer is "Yes", the next step is motor turn off at input/output block 270, followed by setting the motor count at 120 Hz at process block 272. The fast Motor Count is then ready for use in the next motor start up.

If the answer at block 268 is negative, i.e., if the Pulse Width is not zero, the motor is turned on, and the Motor Count is assigned according to the state of the "Tightening" flag. At decision block 274, it is determined if the Tightening flag is on. If it is, at input/output block 276, the motor is caused to move in the brake tightening direction, and the Motor Count is set at the higher frequency value at process block 278. If, at decision block 274, the Tightening flag is not on, at input/output block 280 the motor is caused to move in the brake loosening direction, and the Motor Count is set at the lower frequency value at process block 282.

A further explanation of the terms Pulse Count and Motor Count will be useful. As indicated in the flow charts, Pulse Count is set at Pulse Width (block 266), which was set at PW (block 226). As shown at block 214 in FIG. 8, the PW value has been set as $E/2+A$, which includes an error-related value E and an acceleration-related value A. Pulse Count is a numerical value which is used to control the duty cycle of the motor during the time available within a given Motor Count. Pulse Count is decremented by one (block 256) at each millisecond update. If the Pulse Count during a given Motor Count is sufficiently high,(e.g., a number which is equal to or greater than the total number in the Motor Count) the motor duty cycle may be 100%. A new Pulse Count will be set for the next Motor Count. The numerical values used depend on the experimental results obtained as values are varied.

Motor Count is determined by the desired frequency of the motor during tightening (120 Hz) and loosening (60 Hz) of the friction belt. These values are also based on experimental results. The Motor Count values used are such that the millisecond updates, each of which decrements the Motor Count by one (block 262), create the desired motor frequencies. For example, using a binary value of 8 as the Motor Count will result in a motor frequency of approximately 20 Hz; and using a binary value of 16 as the Motor Count will result in a motor frequency of approximately 60 Hz.

Note that each millisecond update (FIG. 9) decrements by one both the Pulse Count (block 256) and the Motor Count (block 262). Thus, the motor duty cycle will be less than 100% if the Pulse Count is lower than the motor Count.

FIG. 10, headed "16 Hz Service", shows a supervisory routine which slews a speed control value ('Ctrl') toward the user-selected speed command value ('Cmd') at a preselected rate of 10 ft/min/sec, so long as the flywheel is not stopped and the belt is not slack. When the flywheel stops, the Ctrl value is assigned a preselected minimum value; when the belt is slack, the Ctrl value is decremented to the minimum value. The effect of this procedure is to provide gradual, but effective, transition as the user mounts and dismounts the stair-climber. Also, the incremental process toward nulling the error value reduces overshoot and hunting tendencies in the speed control system.

The preselected rate mentioned in the preceding paragraph is an acceleration and deceleration limit value, which controls changes in velocity during starting and stopping of the stair-climber. If desired, the deceleration rate during slow-down may be greater than the acceleration rate during speed-up. When the actual speed and the command speed reach approximate conformity, the limit on the rate of velocity change does not affect operation of the apparatus.

At decision block 290, it is determined whether flywheel speed is greater than zero. If it is not, at process block 292, Control is set at minimum. At decision block 294, if the belt has actuated the slack sensor, the process exits the cycle. If the belt has not actuated the slack sensor, at process block 296 the Tightening flag is cleared, thus setting the system for loosening action. Also, at process block 298, the Pulsewidth is set at 50% of its maximum value.

If, at process block 290, speed is found to be greater than zero, the next step is to determine, at decision block 300, whether the belt has actuated the slack sensor. If the answer at block 300 is Yes, the next stop is a decision at block 302 whether Control is at minimum value. If it is, the process exits the cycle. If the Control is not at minimum value, it is decremented by one at process block 304, and the process exits the cycle.

If the answer at decision block 300 is negative, the process moves to decision block 306, which determines whether Control equals Command (the value selected by the user). If the answer at block 306 is "Yes", the process exits the cycle. If the answer at block 306 is negative, a decision at block 308 determines whether Control is greater than Command. If the answer at block 308 is "Yes", the Control value is decremented by one at process block 304, before exiting the cycle. If the answer at block 308 is negative, indicating that Control is less than Command, the Control value is incremented by one at process block 310, before exiting the cycle.

The incrementing and decrementing unit at blocks 304 and 310 is one foot per minute, based on the nature of the Error value calculated (block 212). If a large Error value exists, as during starting and stopping of the apparatus, the time needed to bring the Control value to the Command value may be several seconds.

The following is a brief summary of the three logic diagrams (FIGS. 8–10). The speed control logic, shown in 'Rev Sensed', is performed when fresh speed information is received, i.e., when the optical sensor detects the edge of a line on the encoder disk. It computes the actual speed, compares it to the control speed, and computes a motor pulse width and a direction flag which it stores in memory. 'Millisecond Update,' as shown in the flow chart, performs two distinct tasks: limit logic and motor signal generation. These functions are mechanical, and could easily be handled in hardware. '16 Hz Update' takes care of matching the control speed to the speed programmed by the user. It also responds to the same limit conditions as the millisecond limit logic, flywheel stopped and belt slack, but at a somewhat higher level. Its response to a stop is to start loosening the belt, a procedure which is eventually stopped by the limit logic. Its response to slack is to decrease the control speed; the millisecond update would do this too quickly to be useful.

The motor control system needs to maintain the actual flywheel speed at the user selected speed with minimum variations, once the stair-climber is in full operation. The motor control system also should be able to cause a gradual speeding up of the flywheel when the user starts the exercise, and a gradual slowing down of the flywheel when the user ends the exercise.

The amount of exercise of the user is determined by the speed of the "climbing" steps and by the height of those steps. In a given setting of the apparatus, a faster change of pedals by the user will be accompanied by a smaller oscillation of the pedals between their upper and lower positions.

As previously stated, mounting and dismounting functions are important aspects of a stair-climbing exercise apparatus. The following is a recapitulation of those functions in the disclosed apparatus.

Assume the user dismounts the climber at or near the programmed speed. The motor may be tightening the belt at the time; this friction, absent input from the user, causes the flywheel to slow down. When it has slowed below the control speed, the motor will loosen the belt according to the speed control logic. The flywheel fails to accelerate because no one is driving it, and the belt continues to loosen until it is slack. The motor is turned off at this point by the millisecond limit logic.

At the next 16 Hz update this situation is recognized and the control speed is reduced. If the actual speed is below this point nothing happens, because the limit logic prevents further loosening when the belt is slack; so at succeeding 16 Hz updates, the control speed is decremented until the control speed becomes less than the actual speed. Once this occurs the belt is tightened again, according to the speed control logic, and the flywheel slows further.

Note that when the belt is tightened it is no longer slack, and the 16 Hz logic will increment the control speed until slack is achieved again. Nevertheless this brief increment is counted back down when the belt slackens, because the speed control logic will not resume tightening until the control speed is below the actual speed.

This sequence of events repeats itself until the flywheel comes to a stop or the user remounts. Upon remount the user accelerates the flywheel, if the belt is slack, exceeding the control speed and causing the belt to tighten. While the belt is not slack, the control speed increments until the programmed speed is attained.

If the user does not remount, the flywheel brakes to a stop, whereupon the 16 Hz service turns the motor on in the loosening direction at half speed. The limit logic turns the motor off when slack is detected.

Mounting a stopped climber is a special case of remounting. The belt is slack, and the control speed is at a minimum, which is quickly exceeded when the user steps on the pedals, causing the belt to tighten and the control speed to ramp toward the programmed speed.

Analysis of the needs of this stair-climbing simulator, has indicated that certain behavioral characteristics are desirable in this machine. It should begin to operate at a low speed when the user initially steps on one of the pedals. The undesired alternatives would be (1) that the machine would abruptly drop the user to the ground due to lack of resistance, or (2) that the machine would be fully braked, supporting the user at the top of the stroke, until the issuance of a starting command. Also, the machine should stop itself and return to its initial condition when the user stops climbing; and it should be capable of resuming operation at its previous setting.

In order to accomplish these ends the controller is furnished with several rules of action in addition to the basic speed control response:

(1) When the flywheel is stopped, the belt is slowly loosened and the control velocity is set to the minimum.

(2) Loosening stops when slack is sensed, and the control velocity is decremented toward the minimum.

(3) The control velocity approaches the user command incrementally while the flywheel is in motion.

The effect of these rules is that the machine starts slowly when the user mounts it, and gradually accelerates to the selected speed (so long as the user keeps up with it). When the user dismounts, the speed drops below the control rate, so the belt is loosened until slack is sensed, whereupon the control rate is gradually decreased, until it is less than the flywheel speed. Then the flywheel is braked until its speed drops below the control rate, and so on. This cycle repeats until the flywheel comes to a stop, whereupon the belt is loosened until slack is sensed. If the user remounts during the slowing process, the flywheel resumes smooth acceleration to the selected speed.

The only actions required of the user are to select a climbing speed, using front panel switches, and to climb at that speed until the exercise is complete.

From the foregoing description, it will be apparent that the apparatus and method disclosed in this application will provide the significant functional benefits summarized in the introductory portion of the specification.

The following claims are intended not only to cover the specific embodiments and methods disclosed, but also to cover the inventive concepts explained herein with the maximum breadth and comprehensiveness permitted by the prior art.

What is claimed is:

1. An exercise apparatus which simulates stair climbing by allowing user effort to lift the user's weight at a desired speed of climbing, comprising;

two user-operated pedals which are separately movable back and forth between upper and lower positions;

each pedal being individually moved downwardly by user climbing effort as the user's weight is lifted into the pedal in its upper position;

means for returning each pedal into its upper position after the user's weight has been removed from its;

a rotating member whose speed of motion is proportional to the speed of climbing by the user;

a friction brake cooperating with the rotating member to maintain the speed of the rotating member at a value representing a preselected climbing rate;

an actuator which exerts force to cause motion in one direction to increase the friction of the brake, and motion in another direction to decrease the friction of the brake;

speed sensing means for providing a value indicating the actual speed of motion attained by the rotating member;

means for providing command speed of motion of the rotating member, representing the user's desired climbing speed;

means for determining whether the actual speed or the command speed is greater than the other; and means for controlling the direction of motion caused by the actuator in response to the speed determining means.

2. The exercise apparatus of claim 1 which also comprises:

means for measuring the amount of difference between the actual speed and the command speed; and means for varying the actuator exerted force in accordance with the amount of difference measured by the measuring means.

3. The exercise apparatus of claim 2 which also comprises:

means for limiting the rate of change of the actual speed during periods when the actual speed would otherwise increase or decrease at a higher rate.

4. The exercise apparatus of claim 1 which also comprises:

means for causing the amount of actuator exerted force to be substantially greater when the brake friction is being increased than when it is being decreased.

5. The exercise apparatus of claim 1 in which the rotating member is a flywheel and the friction brake comprises:

a belt adapted to engage the periphery of the flywheel to provide resistance to flywheel motion.

6. The exercise apparatus of claim 5 in which the motor is a rotary motor connected to one end of the belt, so that rotation of the motor in one direction causes tightening of the belt, and rotation of the motor in the other direction causes loosening of the belt.

7. The exercise apparatus of claim 6 which also comprises:

means for sensing slack in the belt; and means for preventing movement of the motor in the belt loosening direction of slack in the belt is sensed.

8. A user effort controlling system for an exercise apparatus having two user-operated pedals each movable from an upper to a lower position by the user's weight, a flywheel adapted to be driven in a single direction of rotation by the user's weight on either pedal, and means for causing the user's weight on either pedal to exert driving force on the flywheel only when that pedal is moving from its upper to its lower position, the user-effort controlling system comprising:

an anchored friction belt adapted to engage the flywheel to control its speed of rotation, an electrical motor connected to the friction belt for causing tightening or loosening of the belt on the flywheel;

speed sensing means for indicating the actual speed of motion of the flywheel;

speed command means for indicating the user desired flywheel speed;

means for comparing the actual and desired flywheel speeds to determine an error value;

means for causing the motor to tighten the belt on the flywheel when the error value indicates that the actual flywheel speed exceeds the desired speed; and means for causing the motor to loosen the belt on the flywheel when the error value indicates that the desired flywheel speed exceeds the actual speed.

9. The exercise apparatus controlling system of claim 8 which also comprises:

means for sensing slack in the belt if it is loosened to a predetermined extent.

10. The exercise apparatus controlling system of claim 8 which also comprises:

means for establishing a transitional speed control signal which has a different value from the value of the speed command signal from said speed command means; and means for causing the transitional speed control signal to control the rate of actual speed change during periods when the actual and user desired flywheel speeds are being brought into substantial conformity.

11. The exercise apparatus controlling system of claim 8 which also comprises:

motor energy varying means for varying the motor effort during a given time period; and means responsive to the size of the error value for causing the motor energy varying means to provide motor effort which increases or decreases as the size of the error value increases or decreases.

12. The exercise apparatus controlling system of claim 11 in which the motor energy is varied by pulse width modulation.

13. The exercise apparatus controlling system of claim 8 in which means for causing the motor means exerts greater energy when it is tightening the belt than when it is loosening the belt.

14. The exercise apparatus controlling system of claim 8 which also comprises:

a rigid anchor to which the end of the friction belt remote from the motor is connected; and a resilient connection between the friction belt and the anchor, which promotes smooth initial belt and flywheel engagement.

15. The exercise apparatus controlling system of claim 8 which also comprises:

a slack sensor switch located near the motor connected portion of the belt, wherein the switch is maintained in engagement with the belt and is movable by such engagement between switch-opened and switch-closed positions.

16. A method for obtaining a desired user effort level for an exercise apparatus having two user-operated pedals each movable from an upper to a lower position by the user's weight, a flywheel adapted to be driven in a single direction of rotation by the user's weight on either pedal, and means for causing the user's weight on either pedal to exert driving force on the flywheel only when that pedal is moving from its upper to its lower position, the method for obtaining a desired user effort level, comprising:

applying friction to the flywheel to control the speed of the flywheel;

sensing the actual speed of the flywheel;

establishing a user-desired flywheel command speed;

comparing the actual flywheel speed to the desired flywheel speed in order to derive an error value; and varying the friction exerted on the flywheel in order to reduce the error value.

17. The method of claim 16 wherein the step of varying the friction exerted on the flywheel comprises:

tightening or loosening a friction belt engaging the periphery of the flywheel.

18. The method of claim 17 which also comprises:

causing a motor to move in one direction to tighten the friction belt on the flywheel and in another direction to loosen the friction belt on the flywheel.

19. The method of claim 18 which also comprises:

energizing the motor by means of pulses from an electronic controller; and varying the motor energy by changing the width of the pulses in accordance with the size of the error value.

20. A user effort controlling system for an exercise apparatus which simulates stair-climbing and has (a) user-operated pedals each movable from an upper to a lower position by the user's weight at the climbing speed of the user, and (b) a movable member whose speed of motion varies with the climbing speed of the user, the user-effort controlling system comprising:

mechanical friction means for applying friction to the movable member in order to vary its speed of motion;

speed measuring means for establishing the actual speed of motion of the movable member;

user-controlled means for establishing a command speed representing the climbing speed desired by the user;

error-value-determining means for indicating the instantaneous difference between the actual speed established by the speed-measuring means and the command speed established by the user-controlled means; and force-exerting mechanical means which is adapted to (1) exert a force tending to cause a friction increase, in order to slow own the movable member when the error-value-determining means indicates that the actual speed exceeds the command speed, and (2) exert a force tending to cause a friction decrease, in order to speed up the movable member when the error value indicates that command speed exceeds actual speed.

21. The exercise apparatus controlling system of claim 20 which also comprises:

means for increasing and decreasing the force exerted by the force-exerting mechanical means in response to increases and decrease in the amount of difference between actual and command speeds indicated by the error-value-determining means.

22. The exercise apparatus controlling system of claim 20 wherein the force-exerting mechanical means moves in one direction to cause a friction increase and in another direction to cause a friction decrease.

23. The exercise apparatus controlling system 22 which also comprises:

means for sending variable width electrical driving pulses to the force-exerting mechanical means to vary the amount of force exerted on the mechanical friction means.

24. A user-effort controlling system for an exercise apparatus which simulates stair-climbing and has (a) user-operated pedals each movable from an upper to a lower position by the user's weight at the climbing speed of the user, and (b) a movable member whose speed of ;motion varies with the climbing speed of the user, the user-effort controlling system comprising:

mechanical friction means for applying friction to the movable member in order to vary its speed of motion;

speed measuring means for establishing the actual speed of motion of the movable member;

user-controlled means for establishing a command speed representing the climbing speed desired by the user;

error-value-determining means for indicating the instantaneous difference between the actual speed established by the speed-measuring means and the command speed established by the user-controlled means; and an actuator which tends to cause a friction increase when an error value from the error-value-determining means indicates that the actual speed exceeds the command speed, and a friction decrease when the error value indicates that the command speed exceeds the actual speed.

25. The exercise apparatus controlling system of claim 24 which also comprises:

acceleration and deceleration rate limiting means for causing a gradual rate of change of the actual speed of the movable member.

26. The exercise apparatus controlling system of claim 24 which also comprises:

acceleration rate limiting means which tends to insure that speeding up of the movable member is gradual during periods when the movable member is being driven by the user.

27. The exercise apparatus controlling system of claim 24 which also comprises:

deceleration rate limiting means which tends to insure that slowing down of the movable member is gradual during periods when the movable member is not being driven by the user.

28. The exercise apparatus controlling system of claim 24 which also comprises:

means for causing the actuator to tend to increase the friction in response to an increase in the error value when the actual speed is greater than the command speed, and to tend to decrease the friction in response to an increase in the error value when the command speed is greater than the actual speed.

29. The exercise apparatus controlling system of claim 24 which also comprises:

means for causing the actuator to tend to increase the friction in response to an increase in the actual speed, and to tend to decrease the friction in response to a decrease in the actual speed.

30. The exercise apparatus controlling system of claim 24 which also comprises:

means for causing the actuator: (1) to tend to increase the friction in response to an increase in the error value when the actual speed is greater than the command speed, and to tend to decrease the friction in response to an increase in the error value when the command speed is greater than the actual speed; and (2) to tend to increase the friction in response to an increase in the actual speed, and to tend to decrease the friction in response to a decrease in the actual speed.

31. The exercise apparatus controlling system of claim 30 wherein the actuator is an electrical motor connected to the mechanical friction means and the electrical motor is caused to increase or decrease the friction by variations in a duty cycle of the electrical motor.

32. The exercise apparatus controlling system of claim 31 in which the error-value-determining means comprises a microcontroller which:

compares the actual speed and command speed to compute a positive or negative error value;

determines whether a positive or negative change is occurring in actual speed; and sends varying electrical pulses to the electrical motor in order to control the duty cycle of the motor.

33. A user effort controlling method an exercise apparatus which simulates stair-climbing and has (a) user-operated pedals each movable from an upper to a lower position by the user's weight at the climbing speed of the user, and (b) a movable member whose speed of motion varies with the climbing speed of the user, the user-effort controlling method comprising:

measuring the actual speed of motion of the movable member;

establishing a command speed as the climbing speed desired by the user;

establishing a control speed independent of the actual speed and of the command speed;

comparing the control speed to the actual speed;

comparing the control speed to the command speed in order to maintain the user-desired climbing speed;

limiting the rate of change of the control speed in response to the rate of change of the actual speed; and varying resistance to motion of the movable member as a function of the relation between the control speed and the actual speed.

34. A user-effort controlling method for an exercise apparatus which simulates stair-climbing and has (a) user-operated pedals each movable from an upper to a lower position by the user's weight at the climbing speed of the user, and (b) a movable member whose speed of motion varies with the climbing speed of the user, the user-effort controlling method comprising:

measuring the actual speed of motion of the movable member;

establishing a command speed as the climbing speed desired by the user;

establishing a control speed independent of the actual speed and of the command speed;

determining an acceleration-related value by comparing successive measurements of the actual speed;

determining an error-related value by comparing the actual speed to the control speed;

causing an increase in the acceleration-related value to tend to increase resistance to motion of the movable member when the actual speed exceeds the control speed; and causing an increase in the error-related value to tend to increase resistance to motion of the movable member when the actual speed exceeds the control speed.

35. A user-effort controlling method for an exercise apparatus which simulates stair-climbing and has (a) user-operated pedals each movable from an upper to a lower position by the user's weight at the climbing speed of the user, and (b) a movable member whose speed of motion varies with the climbing speed of the user, the user-effort controlling method comprising:

measuring the actual speed of motion of the movable member;

establishing a command speed as the climbing speed desired by the user;

determining an acceleration-related value by comparing successive measurements of the actual speed;

determining an error-related value by comparing the actual speed to the command speed;

calculating an electrical pulse duty cycle value by adding the error-related value to the acceleration related value; and using the electrical pulse duty cycle value to vary the resistance to motion of the movable member.

* * * * *